US007654286B2

(12) United States Patent
Fuegel

(10) Patent No.: US 7,654,286 B2
(45) Date of Patent: Feb. 2, 2010

(54) AUTOMATIC CONCRETE PUMP COMPRISING A MAST SUPPORT UNIT FOR A DISTRIBUTION MAST, WHICH IS FIXED TO THE CHASSIS

(75) Inventor: Dietmar Fuegel, Wolfschlugen (DE)

(73) Assignee: Putzmeister Concrete Pumps GmbH, Aichtal (DE)

( * ) Notice: Subject to any disclaimer, the term of this patent is extended or adjusted under 35 U.S.C. 154(b) by 280 days.

(21) Appl. No.: 10/589,016

(22) PCT Filed: Jan. 14, 2005

(86) PCT No.: PCT/EP2005/000295

§ 371 (c)(1),
(2), (4) Date: Jun. 6, 2007

(87) PCT Pub. No.: WO2005/080706

PCT Pub. Date: Sep. 1, 2005

(65) Prior Publication Data

US 2007/0277881 A1 Dec. 6, 2007

(30) Foreign Application Priority Data

Feb. 13, 2004 (DE) ..... 10 2004 007 509

(51) Int. Cl.
*B67D 5/64* (2006.01)

(52) U.S. Cl. ..... 137/615; 141/387

(58) Field of Classification Search ..... 137/615, 137/351; 141/387

See application file for complete search history.

(56) References Cited

U.S. PATENT DOCUMENTS

| | | | | |
|---|---|---|---|---|
| 6,390,504 | B1 * | 5/2002 | Fetzer | 280/763.1 |
| 6,834,911 | B2 * | 12/2004 | Schillinger et al. | 296/193.07 |
| 7,204,269 | B2 * | 4/2007 | Alwes et al. | 137/615 |

FOREIGN PATENT DOCUMENTS

| | | | |
|---|---|---|---|
| DE | 19 15 722 | A1 | 10/1970 |
| DE | 26 47 103 | C2 | 1/1982 |
| DE | 31 22 725 | A1 | 12/1982 |
| DE | 38 07 966 | C2 | 7/1991 |
| DE | 101 12 084 | A1 | 9/2002 |

OTHER PUBLICATIONS

Schlecht: "Hightech aus Deutschland-Entwicklung und Zukunft der Betonverteilermasten," BMT Baumaschine+Bautechnik, 1993, pp. 72-74, 76, vol. 40, No. 195, Bauverlag GmbH, Wiesbaden, DE.

* cited by examiner

*Primary Examiner*—Kevin L Lee
(74) *Attorney, Agent, or Firm*—Patent Central LLC; Stephan A. Pendorf

(57) ABSTRACT

The invention relates to a mobile concrete pump provided with a chassis, a concrete distribution boom arranged on the chassis, and a boom support unit whereon the folded distribution boom can be supported in the transport position. According to the invention, the boom support unit comprises a housing part which extends above the chassis, is accessible from the outside via closeable openings and comprises at least one support block for the distribution boom which support block is arranged on the top side thereof. The boom support unit can be provided with a switch element which can be actuated by the lying thereupon of the distribution boom, releasing the actuation of the support struts of the mobile concrete pump.

30 Claims, 3 Drawing Sheets

AUTOMATIC CONCRETE PUMP COMPRISING A MAST SUPPORT UNIT FOR A DISTRIBUTION MAST, WHICH IS FIXED TO THE CHASSIS

CROSS-REFERENCE TO RELATED APPLICATION

This application is a national stage of PCT/EP2005/000295 filed Jan. 14, 2005 and based upon DE 10 200 007 509.3 filed Feb. 13, 2004 under the International Convention.

BACKGROUND OF THE INVENTION

1. Field of the Invention

The invention concerns a mobile concrete pump, with a chassis supportable upon a substrate via support outriggers, with a thick matter pump provided on the chassis, with a concrete distribution boom rotatably mounted to a boom block and supportable in the folded transport position on a chassis-fixed boom support unit, and a conveying conduit connected to the pressure side of the concrete pump and running along the distribution boom. The invention further concerns a boom support unit for a mobile concrete pump of the above described type.

2. Description of Related Art

Known mobile concrete pumps of this type include a distribution boom in the form of an articulated boom, of which the boom arms in the operating position are pivotable relative to each other about horizontal articulation axis and pivotable relative to a rotation block. In the transport position the boom arms are folded against each other forming an arm packet and supported on a boom support unit provided in the rearward area of the vehicle chassis. In these known mobile concrete pumps the boom support unit is in the form of a support block, which projects upwards above the platform of the mobile concrete pump fixed to the chassis. There it takes up a certain amount of space, which space might have been suitable for the incorporation of other functional elements of the mobile concrete pump, such as hydraulic pump controls or a water tank. In any case, the boom support unit frequently blocks access to this type of functional element if it were in this space.

SUMMARY OF THE INVENTION

Beginning therewith, it is the task of the invention to modularly design the boom support unit in such a manner that it becomes capable of providing a supplemental function within the mobile concrete pump. The solution of this task is proposed in the combination of characteristics set forth. Advantageous embodiments and further developments of the invention can be seen from the dependent claims.

The inventive solution is characterized above all, in that the boom support unit includes a housing part projecting above the vehicle chassis, which is accessible from outside via a lockable opening and which includes on its upper part at least one support block for the distribution boom. By this means it is achieved, that functional elements of the mobile concrete pump, such as elements of the hydraulic pump control, can be housed within the housing part of the boom support unit for which functional elements, until now, special housings have been necessary. In accordance with the invention, the functional elements are accessible via the lockable opening, for example for servicing purposes of for purposes of manual control. One preferred embodiment of the invention envisions that control elements for the pump drive, in particular changeover valves for the agitator and central lubrication, as well as a pressure reservoir for these aggregates, are provided in the housing part. Since the boom support unit is relatively easily accessible in the rearward area, it is also possible to provide there control switches or levers for the emergency operation of the concrete pump.

A preferred embodiment of the invention envisions that the housing part includes a first and a second frame part, that the first frame part is mounted fixed to the vehicle chassis and carries the control elements in its interior, and that the second frame part can be removed from the first frame part and carries at least one support block on its upper side the. Preferably the frame parts are respectively in the shape of an "L" and can be engaged with each other to form a housing box having a rectangular profile. Therein the at least one support block is advantageously provided on the outside of the upper (horizontal) L-shank of the second frame part. This L-shank can exhibit for this purpose a grid or pattern of holes for securing support blocks various sizes or different design. Further, the second frame part can advantageously exhibit on its side (vertical) L-shank a holder device for a water hose, which can be connected to a water tank equipped with a water pump for cleaning up purposes. Besides this, the second frame part can advantageously exhibit on its side (vertical) L-shank an access opening with a lockable lid.

In a further preferred embodiment of the invention the first frame part preferably includes on its side L-shank a mounting device for a chassis-fixed section of the conveying conduit leading to the distribution boom. This applies in particular for those concrete conveyor pumps, which include an S-pipe switch for a material supply container, of which the conveying conduit is lead along the side past the material supply container and the boom support unit located medially on the vehicle chassis. If the concrete pump however exhibits a C-shaped pivot pipe, of which the conveying conduit is led centrally above the material supply container medially towards the distribution boom, it is of advantage, when the boom support unit in the area of its housing part includes portals or through-openings for the passage-through of the conveying conduit.

Further, according to an advantageous embodiment of the invention, on the second frame part, preferably on its upper L-shank, a bracket or mounting device can be provided for a spray shield, while the first frame part can have provided on its lower rearward area a rubber-elastic spray-protective cover.

Advantageously the boom support unit is located with its housing part in the area between the material supply container of the thick matter pump and a vehicle-fixed water tank.

One preferred embodiment of the invention envisions that at least parts of the housing part and/or the support block of the boom support unit are made of light construction materials. The light construction materials are preferably fiber reinforced plastic, in particular CFRP (carbon fiber reinforced plastic) or GFRP (glass fiber reinforced plastic). Alternatively thereto, the light construction material can be a metal foam, preferably also with aluminum or titanium components. The light construction materials of the housing part and/or the support block preferably carry a friction resistant and/or hard coating, which can be selected for example from the material group chrome, aluminum, silicon carbide or ceramic.

According to an advantageous or alternative embodiment of the invention the boom support unit can be provided on its upper side with a switch element which is actuated by the lying thereupon of the boom, and via which the operation of the support outriggers of the vehicle chassis can be unlocked or activated. Thereby it is achieved that an accidental operation of the support outrigger is precluded in the case that the distribution boom is raised, which could otherwise lead to a tipping of the mobile concrete pump.

BRIEF DESCRIPTION OF THE DRAWINGS

In the following the invention will be described in greater detail on the basis of the illustrative embodiment represented in schematic manner in the figure. There is shown

DETAILED DESCRIPTION OF THE INVENTION

Figure 1:
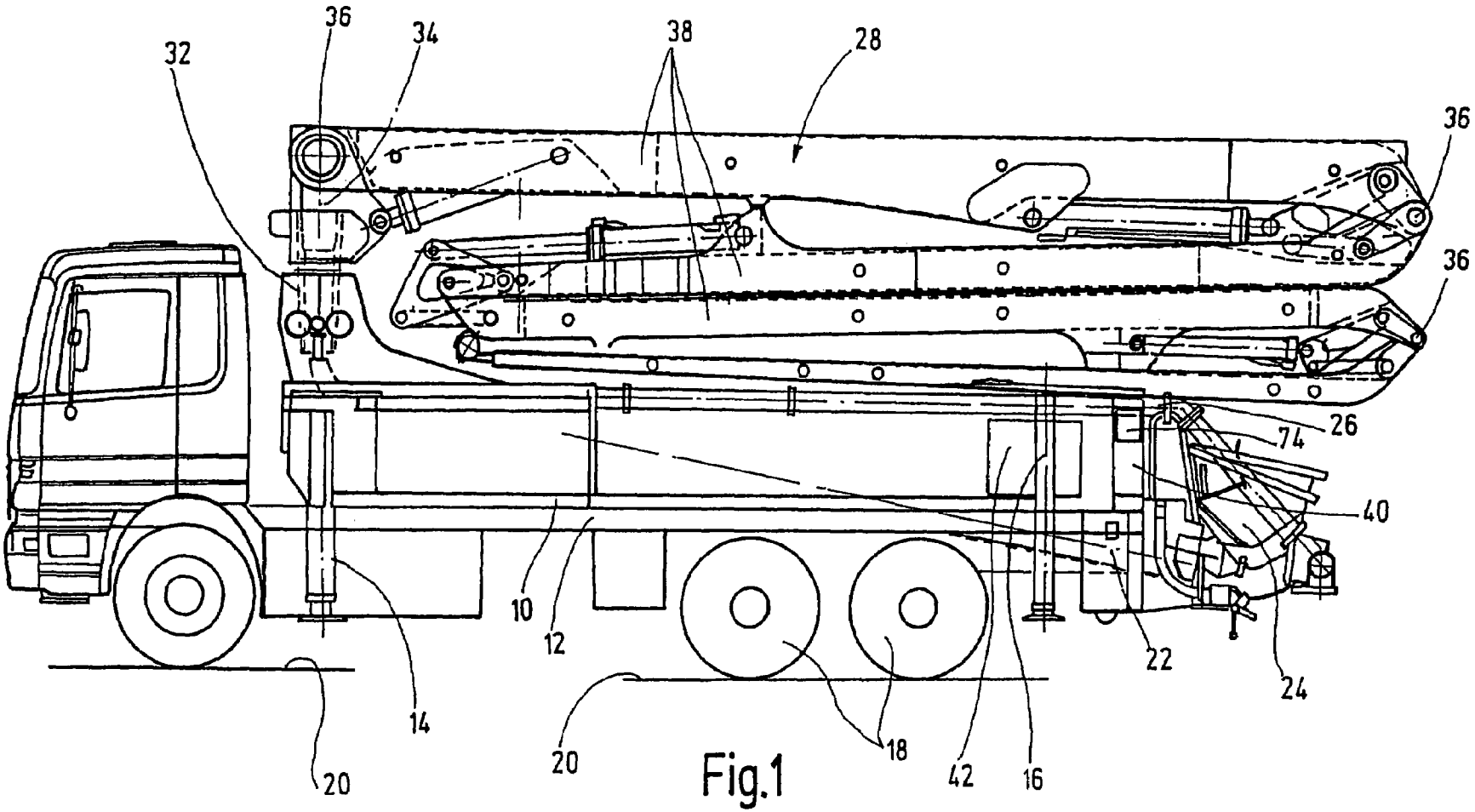
FIG. 1: A side view of a mobile concrete pump with distribution boom in transport position resting upon the boom support unit.
Figure 2:
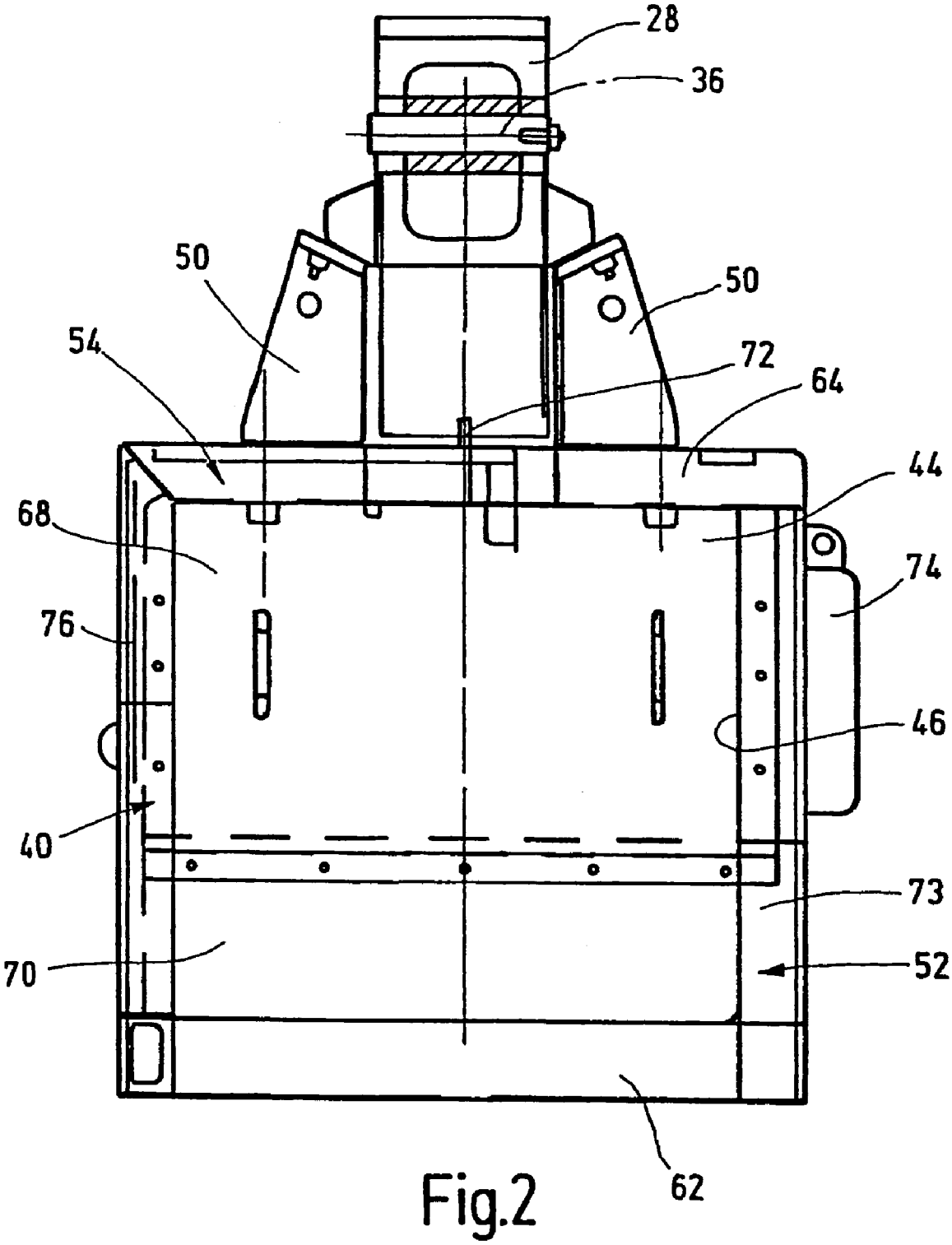
FIG. 2: A rear view of the boom support unit with distribution, lying thereupon.

The mobile concrete pump shown in the figures includes a frame 10 connected rigidly to a truck chassis. Two front and two rear telescopic and/or pivotable support outriggers 14, 16 are provided on the frame 10 with which the vehicle chassis 12 is supportable upon a substrate 20 with lifting of the wheels 18. The mobile concrete pump further includes a two-cylinder thick matter pump 22, which can be supplied with concrete via a material supply container 24 at the rearward part of the chassis. The two-cylinder thick matter pump 22 communicates on the pressure side with a concrete conveying conduit 26, which is guided along a distribution boom 28 in the form of an articulated boom and communicates at its terminal end with a not shown end-hose. The distribution boom 28 is mounted rotatably about a vertical axis 34 on a vehicle chassis fixed rotation block 32. The articulated boom is comprised of multiple boom arms 38 pivotable relative to each other about parallel articulation axis 36, which in the working condition are so adjustable relative to each other, that they are adapted to bridge over the distance to a location to be provided with concrete. In the folded together transport position the boom arms 38 form an arm packet directed rearwards on the chassis, resting on a vehicle chassis fixed boom support unit 40 (see FIGS. 1 and 2). The boom support unit 40 is located, in the illustrated embodiment, on the rearward end of the vehicle chassis 12 between the material supply container 24 and a water tank 42. In the water tank 42 water is transported along to the work site, which is needed at the end of the pumping process for cleaning of the concrete pump.

One special feature of the invention as comprised therein, that the boom support unit 40 is constructed to be hollow, that is, it includes a housing part 44, which is accessible from outside via lockable openings 46, 48 and which on its upper part exhibits at least one support block 50 for supporting the distribution boom 28 in the transport position. As can be seen particularly from FIG. 3, the housing part 44 of the boom support unit 40 is comprised of a first frame part 52 and second frame part 54, which respectively exhibit an L-shaped profile and which compliment each other to form a housing part 44 with rectangular profile. For weight saving reasons, at least parts of the housing part 44 and/or the support block 50 of the boom support unit 40 are comprised of a light construction material, for example of a fiber reinforced plastic, such as CFRP or GFRP or of a metal foam, preferably with aluminum or titanium components. The light construction material of the housing part 44 and/or the support block 50 is preferably provided with a friction resistant and/or hard coating.

In the housing part 44, in the illustrative embodiment, components of the hydraulic pump control 56 including pressure reservoir 58 are provided. Further, actuating lever 60 is accessible there via the opening 46 which enables an emergency operation by hand. The first frame part 52 is fastened with threaded fasteners onto the frame by its lower L-shank 62. The essential parts of the pump control 56 are fixed to the first frame part 52. The second frame part 54 completes the housing part and closes it off along its two open sides and is fastened with threaded fasteners to the first frame part forming a stable frame construction. The support blocks 50 are screwed onto the upper L-shank 64 of the second frame part. Keeping the same design of the second frame part 54, various types of support blocks 50 can be attached depending upon boom type. For this purpose various hole patterns can be provided on the upper L-shank 64 of the second frame part 54, which are intended for various support blocks 50. The open sides of the housing are closed with suitable shields or covers 68. In the lower part there is further provided a rubber skirt 70, which forms a spray shield relative to the adjacent material supply container 24.

Figure 3:
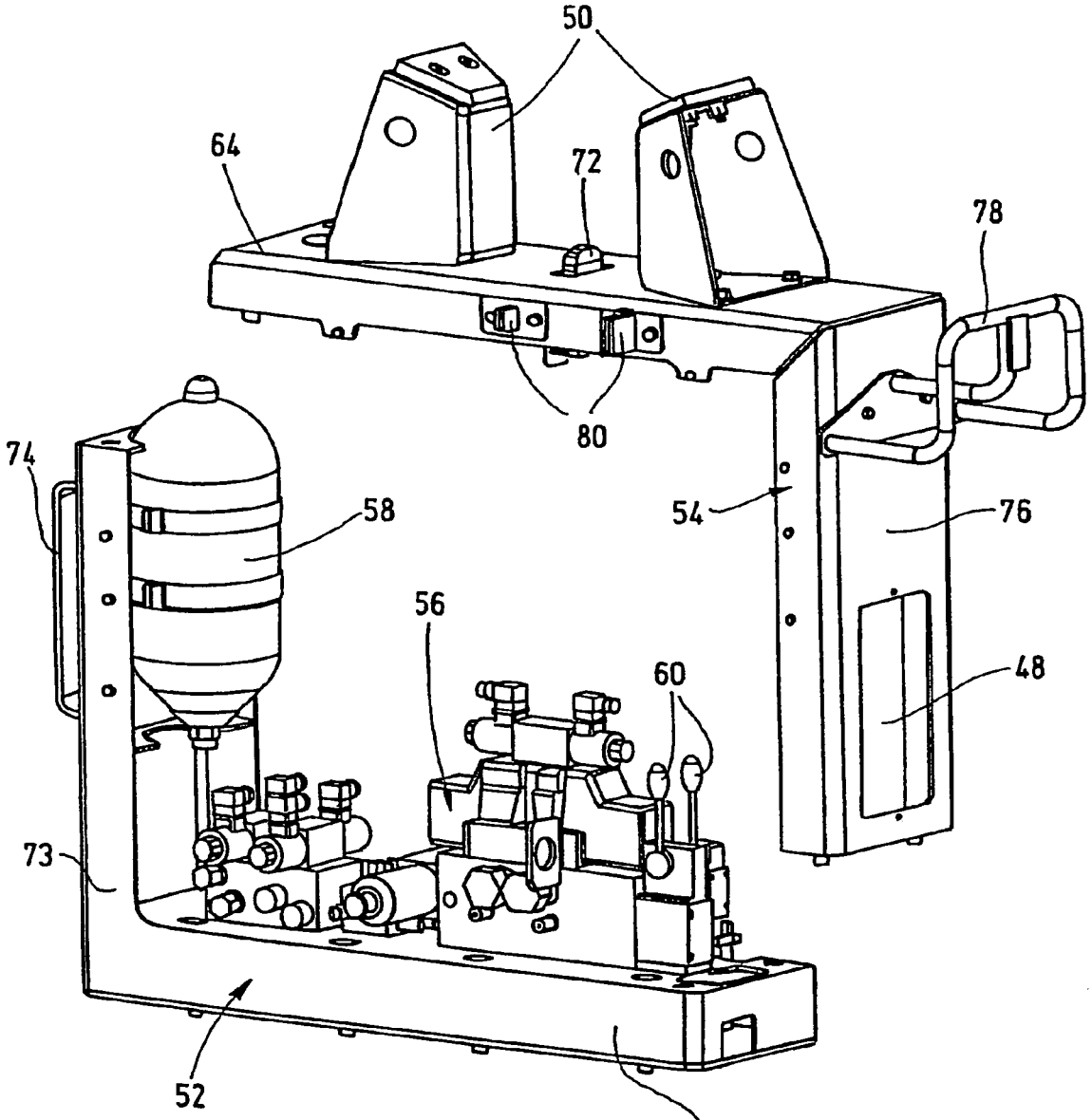
FIG. 3: An illustrative exploded representation of the boom support unit without lid and side wall.

In the free area between the two support blocks 50 there is, in the embodiment shown in FIG. 3, a spring supported or spring biased switch element 72 which is depressed in the case that the distribution boom 28 rests thereupon and, in this condition, frees the actuating mechanism for the support outriggers 14, 16. This safety measure prevents operation of the support outriggers 14, 16 when the distribution boom 28 is raised and in a working position.

On the side L-shank 73 of the chassis-fixed first frame part 52 there is a mounting link via which the pump end of the conveying conduit 26 can be fixed to the chassis in the case that the concrete pump has a S-pipe switch. In the case that the concrete pump has a C-shaped pivot pipe, of which the end is routed above the material supply container medially to the distribution boom, the housing part 44 can be provided with a through-opening on the front and on the rear wall, through which the pump end of the conveying conduit 26 can pass.

From FIG. 3 it can be seen that the side L-shank 76 of the second frame part 54 carries a hook-shaped bent holding device 78 for a water hose connected to the water tank 42. The upper L-shank 64 of the second frame part can additionally be provided with a mounting device 80 for a spray shield extending over a part of the opening of the material supply container 24.

The invention claimed is:

1. A mobile concrete pump provided with a chassis (12) supportable on a substrate via support struts (14, 16), a concrete distribution boom (28) arranged on the chassis (12), a distribution boom (28) rotatably mounted to a distribution block (32) and supportable in the transport position on a chassis-fixed boom support unit (40), and a conveying conduit (26) connected to the pressure side of the concrete pump and running along the distribution boom (28), wherein the boom support unit (40) includes a housing part (44) which extends above the chassis (12), which is accessible from the outside via at least one closeable opening (46, 48) and has on the upper side thereof at least one support block (50) for supporting the distribution boom, wherein the housing part (44) includes a first and a second frame part (52, 54), the frame parts (52, 54) respectively having L-profiles which compliment each other to form a rectangular housing profile, wherein the first frame part is provided fixed to the chassis and the second frame part (54) is removable from the first frame part (52) and carries at least one boom support block (50) on its topside.

2. The mobile concrete pump according to claim 1, wherein control devices for controlling pumps (56) are provided in the first frame part (52).

3. The mobile concrete pump according to claim 1, wherein the at least one support block (50) is provided on the outside of the upper L-shank (64) of the second frame part (54).

4. The mobile concrete pump according to claim 1, wherein the upper L-shank (64) of the second frame part (54) exhibits a hole pattern for securing support blocks (50) of different design and/or size.

5. The mobile concrete pump according to claim 1, wherein the first frame part (52) exhibits, on its side L-shank, a mounting device (74) for a section of the conveying conduit (26) connected to the vehicle chassis.

6. The mobile concrete pump according to claim 1, wherein the second frame part (54) exhibits, on its side L-shank (76), a mounting device (78) for a hose.

7. The mobile concrete pump according to claim 1, wherein the second frame part (54) exhibits, on its side L-shank, an access opening (48) closeable via a lid.

8. The mobile concrete pump according to claim 1, wherein the second frame part (54) exhibits, on its upper L-shank (64), a mounting device for a spray shield.

9. The mobile concrete pump according to claim 1, wherein the first frame part (52) is provided with a rubber skirt (70) on its rear area.

10. The mobile concrete pump according to claim 1, wherein the boom support unit (40) is provided in an area between a material supply container (24) of the thick matter pump (22) and a vehicle chassis fixed water tank (42).

11. The mobile concrete pump according to claim 1, wherein the boom support unit (40) is associated with a switch element (72) actuatable by the lying thereupon of the distribution boom (28), via which the operation of the support outriggers (14, 16) can be cleared or unlocked.

12. The mobile concrete pump according to claim 1, wherein at least parts of the housing part (44) and/or the support block (50) of the boom support unit (40) are comprised of a light construction material.

13. The mobile concrete pump according to claim 12, wherein the light construction material is comprised of a fiber reinforced plastic, in particular carbon fiber reinforced plastic or glass fiber reinforced plastic.

14. The mobile concrete pump according to claim 12, wherein the light construction material is a metal foam, preferably with aluminum or titanium components.

15. The mobile concrete pump according to claim 12, wherein the light construction material of the housing part (44) and/or the support block (50) has a friction resistant and/or hard coating.

16. The mobile concrete pump according to claim 15, wherein the coating is comprised of chrome, aluminum, silicon carbide or ceramic.

17. A boom support unit for a distribution boom of a mobile concrete pump, with a housing part (44), which is accessible from outside via at least one closeable opening (46, 48) and is provided in its upper part with at least one support block (50) for supporting the distribution boom (28), wherein the housing part (44) includes a first and a second frame part (52, 54), that the first frame part carries internally a control device for controlling a pump and that the second frame part (54) is removable from the first frame part (52) and carries on its top side the at least one support block (50), and that the frame parts (52, 54) respectively exhibit an L-profile, complimenting each other to form the perimeter of a rectangular housing.

18. The boom support unit according to claim 17, wherein the at least one support block (50) is provided on the outside of the upper L-shank (64) of the second frame part (54).

19. The boom support unit according to claim 17, wherein the upper L-shank (64) of the second frame part (54) exhibits a hole pattern for the securing of support blocks (50) of different design and/or different size.

20. The boom support unit according to claim 17, wherein the first frame part (52) has on its side L-shank a mounting device for a conveying conduit (26).

21. The boom support unit according to claim 17, wherein the second frame part (54) has on its side L-shank (76) a mounting device (78) for a hose.

22. The boom support unit according to claim 17, wherein the second frame part (54) has on its side L-shank an access opening (48) closeable via a lid.

23. The boom support unit according to claim 17, wherein the second frame part (54) has, on its upper L-shank (64), a mounting device for a spray shield.

24. The boom support unit according to claim 17, wherein the first frame part (52) has on its rear area a rubber skirt (70).

25. The boom support unit according to claim 17, including a switch element (72) actuatable by the lying thereupon of the distribution boom (28).

26. The boom support unit according to claim 17, wherein at least parts of housing (44) and/or the support block (50) of the boom support unit (40) are comprised of the light construction material.

27. The boom support unit according to claim 26, wherein the light construction material is comprised of a fiber reinforced plastic, in particular, carbon fiber reinforced plastic or glass fiber reinforced plastic.

28. The boom support unit according to claim 26, wherein the light construction material is comprised of the metal foam, preferably with aluminum or titanium components.

29. The boom support unit according to claim 26, wherein the light construction material of the housing part (44) and/or the support block (50) carries a friction resistant and/or hard coating.

30. The boom support unit according to claim 29, wherein the coating is selected from the group consisting of chrome, aluminum, silicon carbide and ceramic.

* * * * *